US012276177B2

(12) United States Patent
Books et al.

(10) Patent No.: US 12,276,177 B2
(45) Date of Patent: Apr. 15, 2025

(54) FLOW PATH AND BORE MANAGEMENT SYSTEM AND METHOD

(71) Applicant: OneSubsea IP UK Limited, London (GB)

(72) Inventors: Jacob Taylor Books, Houston, TX (US); Erik Christian Wiest, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 18/565,160

(22) PCT Filed: May 31, 2022

(86) PCT No.: PCT/US2022/031644
§ 371 (c)(1),
(2) Date: Nov. 29, 2023

(87) PCT Pub. No.: WO2022/256342
PCT Pub. Date: Dec. 8, 2022

(65) Prior Publication Data

US 2024/0360738 A1 Oct. 31, 2024

Related U.S. Application Data

(60) Provisional application No. 63/194,946, filed on May 29, 2021.

(51) Int. Cl.
*E21B 33/035* (2006.01)
*E21B 33/04* (2006.01)
*E21B 34/02* (2006.01)

(52) U.S. Cl.
CPC ..... *E21B 34/025* (2020.05); *E21B 33/0355* (2013.01); *E21B 33/04* (2013.01)

(58) Field of Classification Search
CPC ..... E21B 33/0355; E21B 33/04; E21B 34/025
See application file for complete search history.

(56) References Cited

U.S. PATENT DOCUMENTS 4,449,583 A * 5/1984 Lawson ..... E21B 34/16 166/321
5,706,893 A 1/1998 Morgan
(Continued)

FOREIGN PATENT DOCUMENTS

WO 2010022170 A1 2/2010

OTHER PUBLICATIONS

Search Report and Written Opinion of International Patent Application No. PCT/US2022/031644 dated on Sep. 15, 2022; 3 Pages.

*Primary Examiner* — Matthew R Buck
(74) *Attorney, Agent, or Firm* — Eileen Pape; Jeffrey D. Frantz

(57) ABSTRACT

A tubing hanger assembly may include a tubing hanger and an annulus plenum designed for annulus flow that allows for communication of otherwise discontinuous bores and/or flow paths above and below the annular plenum. An annulus plenum flow path arrangement is used to connect discontinuous annulus bores from the top and the bottom of the tubing hanger in a way that maximizes flow through area while leaving space in the tubing hanger for other through bores. Further, a specifically designed flange may reduce the size and quantity of fasteners and be used in areas where radial space does not permit a full flange. The flange is compact and designed to maximize the size of an equipment-loaded bore that needs an end connection while doing so in a space-constrained environment.

13 Claims, 10 Drawing Sheets

(56) References Cited

U.S. PATENT DOCUMENTS

| | | | | |
|---|---|---|---|---|
| 6,082,460 | A * | 7/2000 | June | E21B 33/04 166/368 |
| 6,655,455 | B2 * | 12/2003 | Bartlett | F16K 31/1225 166/368 |
| 9,523,259 | B2 | 12/2016 | Christie | |
| 9,909,393 | B2 * | 3/2018 | Porter | E21B 33/04 |
| 10,450,836 | B2 * | 10/2019 | Mackie | F16K 31/1221 |
| 10,689,921 | B1 | 6/2020 | Murphy | |
| 10,697,270 | B2 | 6/2020 | Lundheim et al. | |
| 10,947,808 | B2 * | 3/2021 | Angers, Jr. | E21B 33/068 |
| 2004/0112604 | A1 | 6/2004 | Milberger et al. | |
| 2005/0016736 | A1 | 1/2005 | Dallas | |
| 2015/0053412 | A1 * | 2/2015 | June | E21B 34/04 166/348 |

* cited by examiner

FLOW PATH AND BORE MANAGEMENT SYSTEM AND METHOD

CROSS-REFERENCE TO RELATED APPLICATION

This application is a National Stage Entry of International Application No. PCT/US2022/031644, filed May 31, 2022, which claims priority to and the benefit of U.S. Provisional Application No. 63/194,946, entitled "FLOW PATH AND BORE MANAGEMENT SYSTEM AND METHOD," filed May 29, 2021, which is hereby incorporated by reference in their entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

The present disclosure generally relates to systems and methods for flow control. In particular, the present disclosure relates to directing, diverting, and blocking a flow through a well.

To meet the demand for natural resources, natural resource exploration and production companies often spend significant amounts of investments in searching for and extracting oil, natural gas, minerals, and other subterranean resources from the earth. Particularly, once a desired natural resource is discovered below the surface of the earth, production systems (e.g., drilling system, mining system) are often employed in a field to access and extract the discovered natural resource. The production systems may be located onshore or offshore depending on the location of the field. Some of the production systems may include a completion system that includes a wellhead assembly through which the discovered natural resource is extracted from the earth. The completion system may include a wide variety of components to control drilling and/or extraction operations. For example, the components may include casings, hangers, valves, fluid conduits, and the like. These components generally include fluid passages to pass a fluid flow. Unfortunately, design constraints in the production systems may result in undesirable flow restrictions in certain components, such as the hangers.

Accordingly, a need exists for a hanger with an improved flow path between upper and lower portions of the hanger.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a system includes a hanger having an annular plenum disposed circumferentially about an axis of the hanger, a first bore extending from a first axial end portion of the hanger to the annular plenum, and a second bore extending from a second axial end portion of the hanger to the annular plenum. Additionally, the first and the second axial end portions are opposite from one another.

In another embodiment, a method includes directing a fluid flow through a first bore extending from a first axial end portion of a hanger to an annular plenum, wherein the annular plenum is disposed circumferentially about an axis of the hanger. The method also includes directing the fluid from the first bore through the annular plenum to a second bore extending from a second axial end portion of the hanger to the annular plenum. Additionally, the first and the second axial end portions are opposite from one another, and the first and the second bores are offset from one another.

In yet another embodiment, a system includes a hanger having an annular wall with an inner annular surface defining a central bore, an outer annular surface disposed about the inner annular surface, and a bore disposed in the annular wall radially between the inner and outer annular surfaces. The hanger also includes a flanged plug coupled to the bore, wherein the flanged plug has a plug portion axially protruding from a flange portion. The flange portion has mounting portions extending laterally beyond the plug portion. Additionally, the flange portion is asymmetric relative to a central axis of the plug portion.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
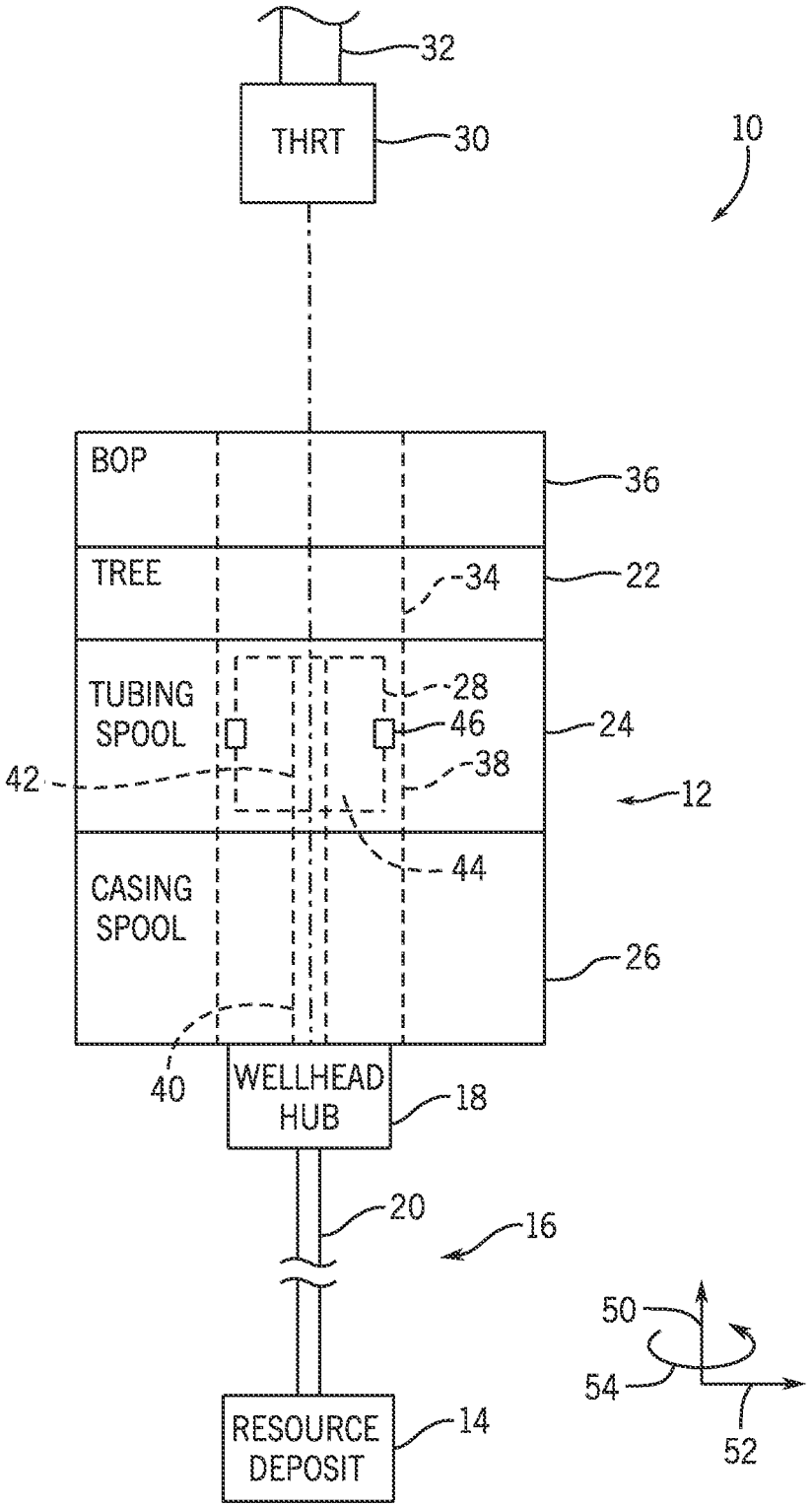
FIG. 1 is a schematic diagram of a system including a tubing hanger assembly, according to an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to7" Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name, but not function.

In certain embodiments, as discussed in further detail below, a plurality of bores extends through an annular wall of a hanger, wherein at least some of the plurality of bores fluidly couple together at an annular plenum between opposite first and second axial end portions of the hanger. The hanger may be used in any surface or subsea application. The hanger may be mounted in a wellhead, in a tree, in a tubing spool, and/or in any suitable location in a resource extraction system coupled to a hydrocarbon reservoir (e.g., oil and/or gas reservoir). The hanger may include a tubing hanger, a casing hanger, or another type of hanger for the resource extraction system. Accordingly, the following discussion is intended to cover all applications of hangers in mineral extraction systems.

As discussed below, each of the plurality of bores is disposed radially between an outer annular surface of the hanger and an inner annular surface of the hanger, wherein the inner annular surface of the hanger defines a central bore of the hanger. Some of the bores may extend completely through the annular wall between the opposite first and second axial end portions of the hanger, and thus may be considered through bores. However, other bores may extend only partially through the annular wall of the hanger, and thus may be considered discontinuous bores. The discontinuous bores are fluidly coupled together by the annular plenum, thereby providing more flexibility in the positioning, number, and overall flow capacity of the discontinuous bores and through bores in the hanger. The discontinuous bores may include a first set of upper bores between the first axial end portion and the annular plenum and a second set of lower bores between the annular plenum and the second axial end portion of the hanger. The annular plenum may be formed toward an outer diameter of the hanger, such as an annular groove along an outer annular surface of the hanger surrounded by an annular sleeve. Additionally or alternatively, the annular plenum may be an integral part of a one-piece construction of the hanger, such as a hanger constructed by additive manufacturing, casting, or some other manufacturing technique. In certain embodiments, the annular wall includes a valve configured to control the fluid flow through the annular plenum between the upper bores and the lower bores. Additional details of the through bores, the discontinuous bores, and the annular plenum are discussed below.

With the foregoing in mind, FIG. 1 is a schematic diagram of an embodiment of a resource extraction system 10 having a tubing hanger 28 with various improvements as discussed in further detail below. The illustrated embodiment is intended as only one possible non-limiting example for a hanger (e.g., tubing hanger 28) have the unique features described herein. As appreciated, the hanger (e.g., tubing hanger 28) described herein may be mounted in any suitable component of the resource extraction system 10 (e.g., surface or subsea system), and thus the following discussion of FIG. 1 is intended to provide one possible context for the hanger (e.g., tubing hanger 28). Accordingly, prior to a detailed discussion of the tubing hanger 28 improvements, the resource extraction system 10 and its components are discussed to provide context for the tubing hanger 28. The resource extraction system 10 may be configured to extract various natural resources, such as minerals and hydrocarbons (e.g., oil and/or natural gas), from the earth. Additionally or alternatively, the resource extraction system 10 may be configured to inject substances (e.g., water, carbon dioxide, chemicals) into the earth. The resource extraction system 10 may be land-based (e.g., a surface system) or subsea (e.g., a subsea system). As shown, the resource extraction system 10 includes a wellhead 12 coupled to a resource deposit 14 via a well 16. The well 16 includes a wellhead hub 18 and a wellbore 20. The wellhead hub 18 may include a large diameter hub that is disposed at a termination of the wellbore 20. The wellhead hub 18 provides for a connection of the wellhead 12 to the well 16.

The wellhead 12 may include multiple components that control and regulate activities and conditions associated with the well 16. For example, the wellhead 12 may include bodies, valves, and seals that route extracted natural resources from the resource deposit 14, provide for regulating pressure in the well 16, and/or provide for the injection of the substances into the wellbore 20. In the illustrated embodiment, the wellhead 12 includes a tree 22, a tubing spool 24 (e.g., tubing housing), a casing spool 26 (e.g., casing housing), and a tubing hanger 28. The resource extraction system 10 may include other device(s) that are coupled to the wellhead 12 and/or that are used to assemble and/or control various components of the wellhead 12. For example, in the illustrated embodiment, the resource extraction system 10 includes a tubing hanger running tool (THRT) 30 suspended from a drilling string 32. During a running or lowering process for the tubing hanger 28, the THRT 30 is coupled to the tubing hanger 28. The THRT 30 and the tubing hanger 28 are lowered (e.g., run) together into the wellhead 12. Once the tubing hanger 28 has been lowered into a landed position in the tubing spool 24, the tubing hanger 28 may be locked into a locked position in the tubing spool 24. Then, the THRT 30 may be uncoupled from the tubing hanger 28 and extracted from the wellhead 12 by the drilling string 32.

The tree 22 (sometimes referred to in the oil and gas industry as a Christmas tree) may be installed on top of the tubing spool 24. The tree 22 may include a variety of flow paths (e.g., bores), valves, fittings, and controls for operating the well 16. For instance, the tree 22 may include a frame that is disposed about a tree body, a flow-loop, actuators, and valves. Further, the tree 22 may be in fluid communication with the well 16. As illustrated, the tree 22 includes a tree bore 34. The tree bore 34 provides for completion and workover procedures, such as the insertion of tools into the wellhead 12, the injection of various chemicals into the well 16, and the like. Further, natural resources extracted from the well 16 (e.g., oil and/or natural gas) may be regulated and routed via the tree 22. For instance, the tree 22 may be coupled to a jumper or a flowline that is tied back to other components, such as a manifold. Accordingly, extracted natural resources flow from the well 16 to the manifold via the tree 22 before being routed to shipping or storage facilities. A blowout preventer (BOP) 36 may also be included, either as a part of the tree 22 or as a separate device. The BOP 36 may include a variety of valves, fittings, and controls to block oil, gas, or other fluid from exiting the well 16 in the event of an unintentional release of pressure or an overpressure condition. It should be appreciated that a lubricator may be utilized in place of the BOP 36 (e.g., to deploy components into the wellhead 12).

The tubing spool 24 provides a base for the tree 22. The tubing spool 24 has a tubing spool bore 38, and the casing spool 26 has a casing spool bore 40. The tubing spool bores 38 and casing spool bore 40 connect (e.g., enable fluid communication between) the tree bore 34 and the well 16. Thus, the tubing spool bores 38 and casing spool bore 40 may provide access to the wellbore 20 for various completion and workover procedures. For example, components may be run down to the wellhead 12 and disposed in the tubing spool bore 38 and/or the casing spool bore 40 to seal-off the wellbore 20, to inject chemicals downhole, to suspend tools downhole, to retrieve tools, and the like.

The wellbore 20 may contain elevated fluid pressures. For example, pressures within the wellbore 20 may exceed 10,000 pounds per square inch (PSI), 15,000 PSI, or 20,000 PSI. Accordingly, the resource extraction systems 10 may employ various mechanisms, such as mandrels, seals, plugs, and valves, to control and regulate the fluid pressure in the wellbore 20. For example, the tubing hanger 28 may be disposed within the tubing spool 24 to secure tubing suspended in the wellbore 20 and to provide a path for hydraulic control fluid, chemical injection, electrical connection(s), and the like. The tubing hanger 28 includes a central bore 42 that extends through the center of a tubing hanger body 44 and that is in fluid communication with the casing spool bore 40 and the wellbore 20. The central bore 42 is configured to facilitate flow of hydrocarbons through the tubing hanger body 44.

As shown, a lock ring 46 (e.g., metal ring; c-shaped ring) may be coupled to the tubing hanger 28, such that the lock ring 46 is disposed between the tubing spool 24 and the tubing hanger 28. After the tubing hanger 28 reaches the landed position in the tubing spool 24, the lock ring 46 may be actuated or engaged (e.g., expanded) to cause the tubing hanger 28 to be in the locked position in the tubing spool 24. For example, rotation and/or withdrawal of the THRT 30 may enable the lock ring 46 to expand radially-outwardly to engage the tubing spool 24. Once the lock ring 46 is engaged with the tubing spool 24, the lock ring 46 may block withdrawal or extraction of the tubing hanger 28 from the tubing spool 24. To facilitate discussion, the resource extraction system 10 and its components may be described with reference to an axial axis or direction 50, a radial axis or direction 52, and a circumferential axis or direction 54. Additionally, the tubing hanger 28 and the lock ring 46 may together be considered to form an insert or a tubing hanger assembly. Furthermore, the tubing hanger 28, the THRT 30, and the lock ring 46 may together be considered to form a tubing hanger running assembly.

Figure 2:
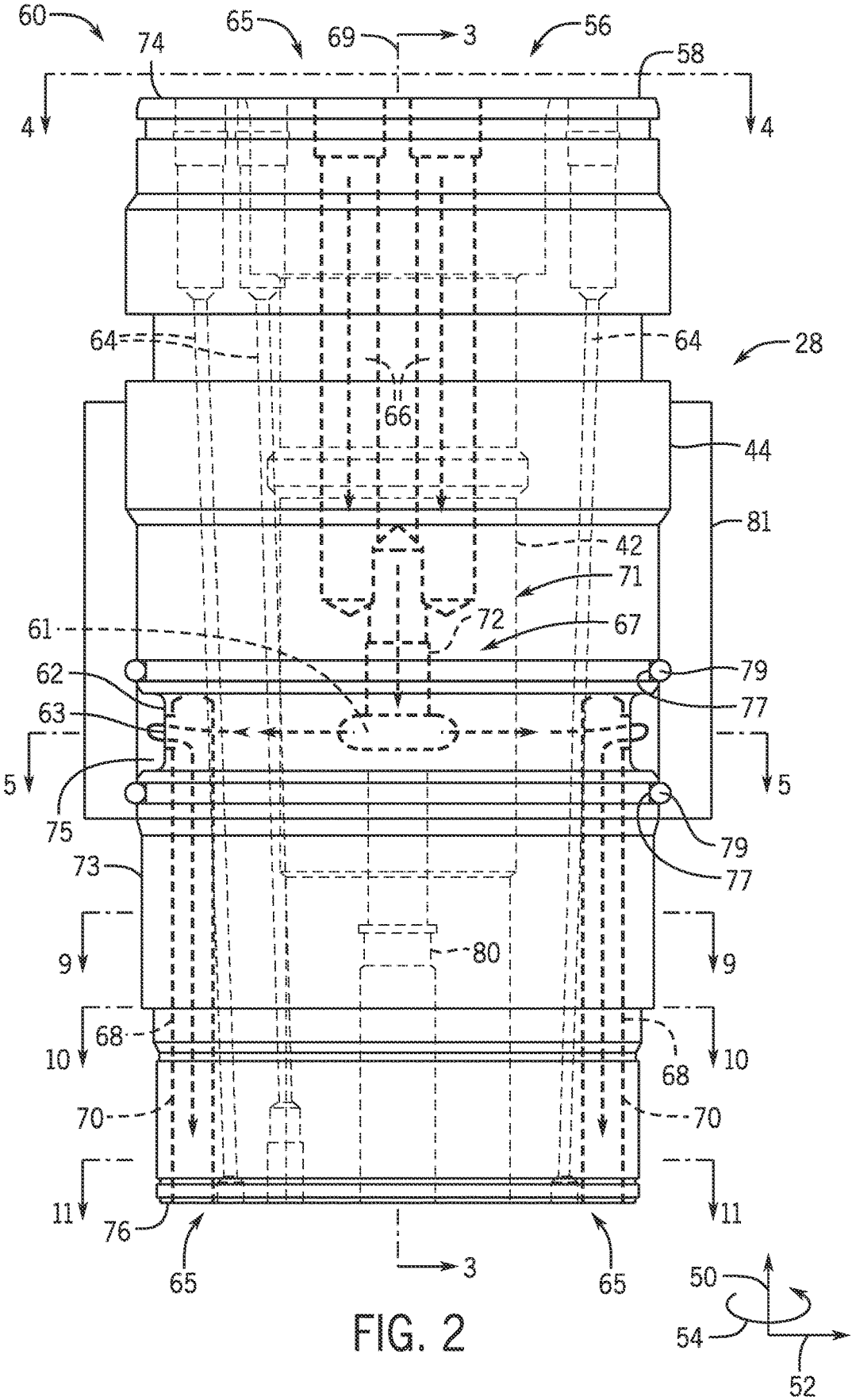
FIG. 2 is a cross-sectional view of the tubing hanger assembly, according to an embodiment of the present disclosure.

FIG. 2 is a cross-sectional view of a tubing hanger assembly 60. As illustrated, the tubing hanger assembly 60 includes the tubing hanger 28, an annulus or annular plenum 62, and one or more valves. The tubing hanger 28 may include the tubing hanger body 44 and a variety of annulus bores 56 disposed in an annular wall 58 of the tubing hanger body 44 (e.g., annular body). For example, the annulus bores 56 may include through bores 64, discontinuous bores 65, and intersecting bores 67. The annulus bores 56 (e.g., through bores 64, discontinuous bores 65, and intersecting bores 67) may include axial bores, angled bores that are angled in the radial direction 52, angled bores that are angled in the circumferential direction 54 (e.g., spiral bores), or any combination thereof. However, axial bores are intended as one possible example of the bores 56 for purposes of discussion. Additionally, the annulus bores 56 (e.g., through bores 64, discontinuous bores 65, and intersecting bores 67) may have the same or different sizes (e.g., diameters or cross-sectional areas), the same or different radial positions in the radial direction 52, the same or different circumferential positions in the circumferential direction 54, or any combination thereof. For example, the discontinuous bores 65 may be aligned or misaligned (e.g., offset radially and/or circumferentially) relative to one another on axially opposite sides of the annular plenum 62 (e.g., on first side between the annular plenum 62 and the first axial end portion 74 and the second side between the annular plenum 62 and the second axial end portion 76). However, regardless of whether the discontinuous bores 65 are aligned or misaligned with one another, the discontinuous bores 65 are fluidly coupled together via the annular plenum 62. The annular plenum 62 facilitates connections between the discontinuous bores 65, thereby providing for more flexibility in the sizes, placements, numbers, etc. of the discontinuous bores 65 for improved throughput of the fluid flow.

In certain embodiments, the annulus bores 56 (e.g., through bores 64, discontinuous bores 65, and intersecting bores 67) may have common or different diameters (or cross-sectional areas) relative to one another. Additionally, each of the through bores 64 may be sized the same or different from one another, each of the discontinuous bores 65 may be sized the same or different from one another, and each of the intersecting bores 67 may be sized the same or different from one another. When connecting the annulus bores 56, the connected bores may have sizes (e.g., diameters or cross-sectional areas) that provide substantially the same fluid flow rate, such that the connected bores do not result in a substantial flow restriction, but rather the connected bores maintain the fluid flow rate through the tubing hanger 28. However, in some embodiments, the connected bores 56 may be configured to restrict or further open the flow path from one bore to another in the direction of fluid flow.

The discontinuous bores 65 may include any number of upper bores or passages (e.g., upper bores 66) and lower bores or passages (e.g., 68 and 70), such as 1, 2, 3, 4, 5, 6, 7, 8, 9, 10, or more of each of the upper and lower bores. The discontinuous bores 65 (e.g., 66, 68, and 70) may include axial bores and/or angled bores. The discontinuous bores 65 may include individual bores and/or pairs or larger sets of bores, such as pairs or sets of bores that are more closely spaced relative to one another. The following discussion refers to specific numbers and pairs of the discontinuous bores 65; however, the provided examples of the upper and lower bores 66, 68, and 70 are not intended to be limiting in any manner, and thus embodiments of the upper and lower bores may include any suitable number, size, and placement of the upper and lower bores to increase throughput in the annular wall 58 of the tubing hanger 28. For example, the discontinuous bores 65 may include two or more upper bores 66 (e.g., axial upper bores or passages) and two or more pairs of lower bores 68 and 70 (e.g., axial lower bores or passages). The intersecting bores 67 may include one or more intersecting bores 72 (e.g., axial intersecting bores or passages) disposed between the upper bores 66 and fluidly coupled to both the upper bores 66 and the lower bores 68 and 70 via the annular plenum 62. The through bores 64, discontinuous bores 65, and intersecting bores 67 are disposed in the annular wall 58 between an inner surface (e.g., inner annular surface 82) defined by the central bore 42 (e.g., main bore coaxial with centerline 69) and the outer surface (e.g., outer annular surface 73) of the tubing hanger body 44. In other words, the through bores 64, discontinuous bores 65, and intersecting bores 67 are disposed radially outside of the central bore 42 within the annular wall 58 (e.g., within the radial thickness of the annular wall 58).

In the illustrated embodiment, the through bores 64 (e.g., axial through bores or passages) extend completely through the annular wall 58 from a first axial end portion 74 of the tubing hanger 28 to a second axial end portion 76 of the tubing hanger 28, and thus are considered through bores. The through bores 64 extend an entire axial length of the tubing hanger 28. For example, the through bores 64 may be machined or drilled in the axial direction 50 through the annular wall 58 from the first axial end portion 74 to the second axial end portion 76, or from the second axial end portion 76 to the first axial end portion 74. The through bores 64 may provide various paths for fluids and connections. For example, in some embodiments, the through bores 64 may provide paths through which various fluids (e.g., hydraulic control fluid, lubricating fluid, chemical injection fluid) may flow. In some embodiments, the through bores 64 may provide paths through which various lines and/or cables (e.g., chemical injection lines, electrical power lines, electrical communication lines conveying control signals and/or sensor data, fiber optical cables) may pass.

In the illustrated embodiment, the discontinuous bores 65 (e.g., bores 66, 68, and 70) extend only partially through the annular wall 58 between the first and second axial end portions 74 and 76 of the tubing hanger 28, and thus are considered discontinuous bores. The discontinuous bores 65 may exist for various reasons. In some embodiments, the tubing hanger 28 may have an issue of spacing, such as not having a space to run a single bore straight through the tubing hanger 28. In some embodiments, the tubing hanger 28 may include a valve used to block, disrupt, or isolate an annulus flow to control the communications of the annulus flows above and below the tubing hanger 28. The discontinuous bores 65 extend only a partial axial length of the tubing hanger 28, for example, by drilling or machining the discontinuous bores 65 in the axial direction 50 only partially through the annular wall 58 from the first axial end portion 74 toward but not reaching the second axial end portion 76, or from the second axial end portion 76 toward but not reaching the first axial end portion 74. In the illustrated embodiment, the discontinuous bores 65 are drilled or machined into the annular wall 58 from both the first and second axial end portions 74 and 76.

For example, the upper bores 66 may extend from the first axial end portion 74 of the tubing hanger 28 to an intermediate position 71 between the first axial end portion 74 and the annular plenum 62. The upper bores 66 may be circumferentially offset (or spaced apart) from one another in the circumferential direction 54 about the axial axis 50 (e.g., centerline 69), radially offset (or spaced apart) from one another in the radial direction 52 relative to the axial axis 50 (e.g., centerline 69), or a combination thereof. However, as discussed above, the upper bores 66 may be axial bores or passages extending in the axial direction 50 along the centerline 69. As illustrated, the two upper bores 66 are joined by the intersecting bore 72 extending from the intermediate position 71 to the annular plenum 62. The annular plenum 62 allows for a communication of the two upper bores 66 and one or more (e.g., 1, 2, 3, or 4) bores of the two pairs of lower bores 68 and 70 via the intersecting bore 72. As further illustrated in FIG. 2, the annular plenum 62 may couple with the intersecting bore 72 via a cross-bore 61 (e.g., radial bore or passage) extending in the radial direction 52 between the annular plenum 62 and the intersecting bore 72.

The two pairs of lower bores 68 and 70 may extend from the second axial end portion 76 of the hanger to the annular plenum 62. For example, the two pairs of lower bores 68 and 70 may be drilled or machined into the annular wall 58 through the second axial end portion 74 in the axial direction 50 toward the annular plenum 62. The pair of lower bores 68 may be circumferentially offset (or spaced apart) from one another in the circumferential direction 54 about the axis 50. The pair of lower bores 70 may be circumferentially offset (or spaced apart) from one another in the circumferential direction 54 about the axis 50, and also circumferentially offset (or spaced apart) from the pair of lower bores 68 in the circumferential direction 54 about the axis 50. Each of the lower bores 68 and 70 may be coupled to the annular plenum 62 with a cross-bore 63 (e.g., radial bore or passage) extending in the radial direction 52 between the annular plenum 62 and the respective lower bores 68 and 70.

The annular plenum 62 is disposed circumferentially about the axis 50 (e.g., centerline 69) of the tubing hanger 28 at least partially within the annular wall 58. In certain embodiments, the annular plenum 62 is an annular plenum, recess, groove, or passage that is coaxial with the centerline 69, wherein the annular plenum 62 extends in a plane normal to the centerline 69. However, in some embodiments of the tubing hanger 28, the annular plenum 62 may be off-center relative to the centerline 69, the annular plenum 62 may extend in a plane angled to the centerline 69 (e.g., angled between 45 to 90 degrees), or any combination thereof. The annular plenum 62 is a plenum space designed for annulus flow management within the annular wall 58. For example, the annular plenum 62 may enable an annular plenum flow path arrangement that allows for communication(s) of otherwise discontinuous bores 65 (e.g., the two upper bores 66, the two pairs of lower bores 68 and 70) and/or flow paths above and below the annular plenum 62. The annular plenum 62 may be used to connect the discontinuous bores 65 from the top and the bottom of the tubing hanger 28 in a way that increases (e.g., maximizes) flow through area(s) while leaving considerable space in the tubing hanger 28 for other tubing bores (e.g., the through bores 64).

The annular plenum 62 may be a feature or mechanism in the tubing hanger 28 that acts as a manifold (or common mixing and distribution chamber) for comingling annulus flows through the discontinuous bores 65 that access the annular plenum 62 from above and below and extend to the top and bottom of the tubing hanger body 44, respectively. By comingling the discontinuous bores 65, the annular plenum 62 enables communications of the annulus flows above and below the tubing hanger 28. The annular plenum 62 may have any suitable geometry that provides a volume for discontinuous bores 65 to intersect and allow for communication and flow.

The annular plenum 62 may be designed as an integral annular passage internally formed within the annular wall 58, an annular passage partially defined by the annular wall 58 and a surrounding annular sleeve 81, or another suitable construction. In the illustrated embodiment, the annular plenum 62 extends radially into an outer annular surface 73 of the annular wall 58 to define an annular groove 75 in the tubing hanger body 44, for example, by machining the annular groove 75 into the outer annular surface 73. Additionally, a pair of seal grooves 77 (e.g., annular seal grooves) may be formed in the annular wall 58 on axially opposite sides of the annular groove 75, for example, by machining the seal grooves 77 into the outer annular surface 73. For example, as illustrated in the cross-section of FIG. 2, the annular groove 75 may define three edges or sides of the annular plenum 62. Seals 79 (e.g., elastomeric seal rings) may be installed into the seal grooves 77 to provide sealing about the annular groove 75. An annular sleeve 81 may be installed around the annular wall 58, such that the annular sleeve 81 extends completely over the annular groove 75 and the seals 79. Thus, the annular sleeve 81 is concentric with the outer annular surface 73 and closes off a radially outer side of the annular groove 75. As a result, annular plenum 62 is defined by the annular groove 75 within the annular wall 58, the seals 79 in the seal grooves 77, and the annular sleeve 81. The seals 79 are configured to seal within the seal grooves 77 and against an inner annular surface of the annular sleeve 81, thereby providing a sealed annular interface (or fourth edge or side) of the annular plenum 62.

In operation, a fluid flow may pass through the bores in the annulus bores 56 in a first direction from the first axial end portion 74 toward the second axial end portion 76 and/or in a second direction from the second axial end portion 76 toward the first axial end portion 74. For example, the fluid flow may pass in the first and/or second direction through the through bores 64. By further example, the fluid flow may pass through the upper bores 66, the intersecting bore 72, the cross-bore 61, the annular plenum 62, the cross-bores 63, and the lower bores 68 and 70. Additionally or alternatively, the fluid flow may pass through the lower bores 68 and 70, the cross-bores 63, the annular plenum 62, the cross-bore 61, the intersecting bore 72, and the upper bores 66.

As mentioned above, the tubing hanger 28 may include a valve 80 used to block, disrupt, or isolate an annulus flow to control communications of annulus flows above and below the tubing hanger 28. For instance, the valve 80 may include a tubing hanger annulus isolation device (THAID) (hereinafter, referred to as THAID 80) disposed in the intersecting bore 72 between the annular plenum 62 and the second axial end portion 76. The THAID 80 may be used to block off annulus flow, disrupting the communication of the annulus above and below the tubing hanger 28, and isolating annulus fluid (e.g., hydraulic control fluid, lubricating fluid, chemical injection fluid) on either side of the tubing hanger 28. Additional details related to functions and operations of the THAID 80 will be described below with reference to FIGS. 6-8.

Figure 3:
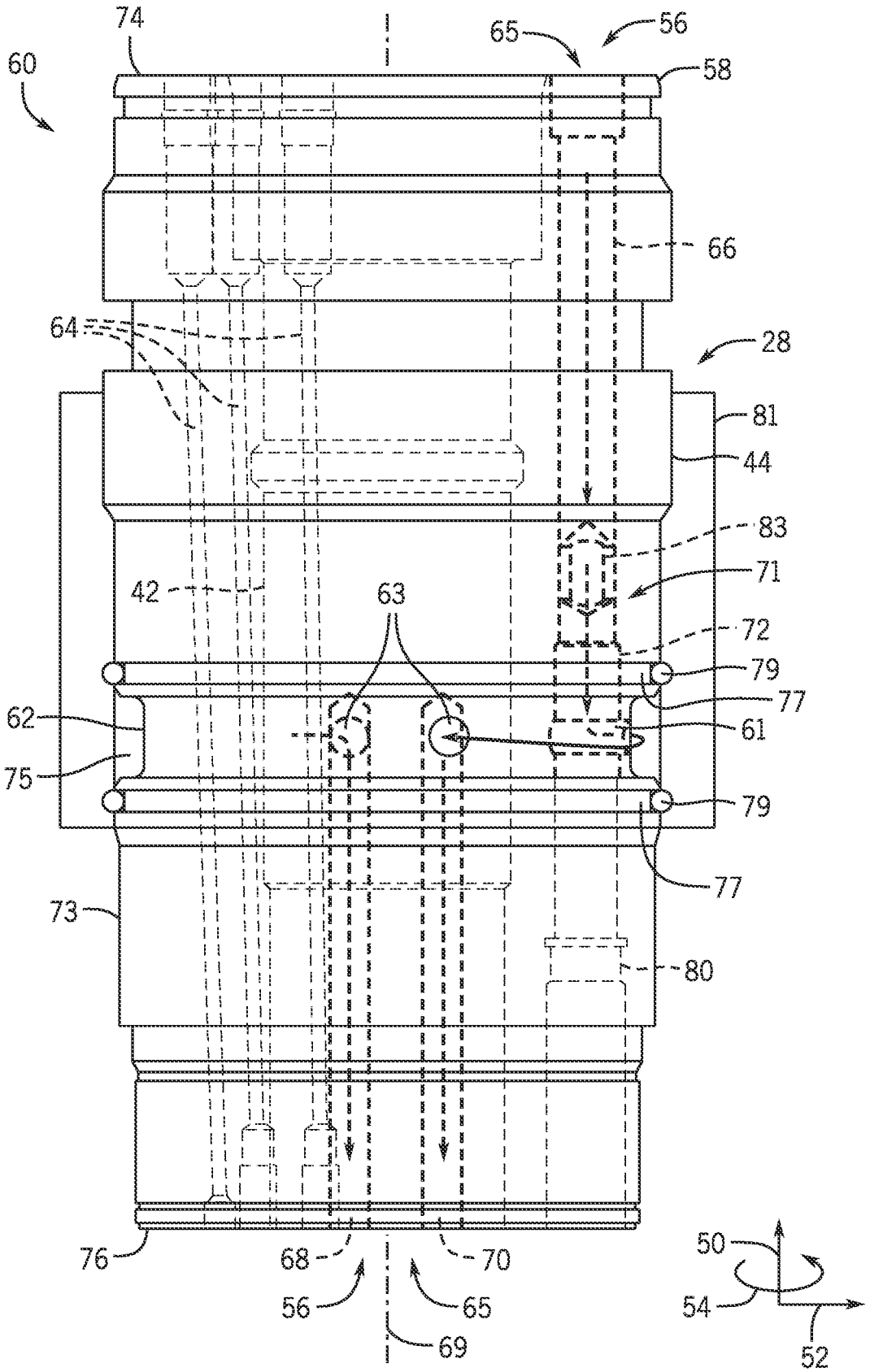
FIG. 3 is a cross-sectional view of the tubing hanger assembly taken along line 3-3 of FIG. 2, according to an embodiment of the present disclosure.

FIG. 3 is a cross-sectional view of the tubing hanger assembly 60 taken along line 3-3 of FIG. 2, further illustrating details of the annulus bores 56 in the annular wall 58. As illustrated, the cross-section of FIG. 3 is rotated 90 degrees about the centerline 69 relative to the cross-section of FIG. 2. FIG. 3 further illustrates a number of features discussed above with reference to FIG. 2. For example, FIG. 3 illustrates the fluid connection between the upper bores 66 and the intersecting bore 72 at the intermediate position 71, wherein openings 83 extend circumferentially between the intersecting bore 72 and the surrounding upper bores 66. FIG. 3 also illustrates the cross-bore 61 extending in the radial direction 52 from the intersecting bore 72 to the annular plenum 62. Additionally, FIG. 3 illustrates the cross-bores 63 extending in the radial direction 54 (i.e., out of the page in FIG. 3) from each lower bore 68 and 70 into the annular plenum 62.

In the illustrated embodiment, a fluid above the tubing hanger 28 may enter the upper bores 66 at the first axial end portion 74 of the tubing hanger 28, flow through the upper bores 66 in an axial direction to the intersecting bore 72 at the intermediate position 71, flow through the intersecting bore 72 in the axial direction to the cross-bore 61, flow through the cross-bore 61 in the radial direction into the annular plenum 62, flow through the annular plenum 62 in the circumferential direction to the cross-bores 63, flow through the cross-bores 63 in the radial direction into the pair of lower bores 68 or 70, and flow through the pair of lower bores 68 and 70 in the axial direction until existing through the second axial end portion 76 of the tubing hanger 28. Additionally or alternatively, the fluid flow may pass through the annulus bores 56 in an opposite direction from the second axial end portion 76 to the first axial end portion 74.

In the illustrated embodiment, the annular plenum 62 is part of the tubing hanger 28, rather than being a separate annular flow area above or below the tubing hanger 28. The annular plenum 62 is configured to help mix and distribute the fluid flow between the upper and lower bores 66, 68, and 70, while maintaining relatively high flow rates through the tubing hanger 28. The annular plenum 62 also helps to increase the overall fluid flow through the annular wall 58 of the tubing hanger 28. For example, the annular plenum 62 allows fluid communication between the upper bores 66 and the lower bores 68 and 70 without interfering with the through bores 64.

In contrast, other equipment or systems may use different method of achieving communication between upper and lower annulus bores (e.g., upper bores 66 and lower bores 68 and 70), such as using a cross-drilled lateral bore (e.g., extending in circumferential direction 54) that intersects the upper and lower annulus bores 66, 68, and 70. However, the cross-drilled lateral bore may cut off or interfere with other passages, such as through bores 64. Additionally, the cross-drilled lateral bore may be machined from the outside of the tubing hanger body 44, such that a plug may be used to seal the cross-drilled lateral bore. The plug is equal to or greater in size than the diameter of the cross-drilled lateral bore. As such, a large plug is used to plug a large cross-drilled bore that provides a large flow through area. Plugging the large cross-drilled bore in a limited space (e.g., at the end of the tubing hanger) may be difficult and may leave insufficient space for other annulus bores.

The use of the annular plenum 62 may overcome various problems associated with a separate annular flow area above or below the tubing hanger 28 and/or a cross-drilled lateral bore. As illustrated previously, the annular plenum 62 allows for fluid communication of annulus flows above and below the tubing hanger 62 via discontinuous bores 65 (e.g., the upper bores 66 and two pairs of lower bores 68 and 70). The annular plenum 62 moves the annulus flows to the outside of the tubing hanger body 44 and wraps around (e.g., fluid flows in the circumferential direction 54), thereby retaining considerable space for other annulus bores 56 (e.g., the through bores 64) to pass through and allow for increasing (e.g., maximizing) the flow through area through the annular wall 58 of the tubing hanger 28. Additionally, the use of the annular plenum 62 may avoid the problem of plugging a cross-drilled bore by using communication(s) of the discontinuous bores (e.g., the two upper bores 66, the two pairs of lower bores 68 and 70) and/or the flow paths above and below the annular plenum 62, which do not involve a plugged end.

Figure 4:
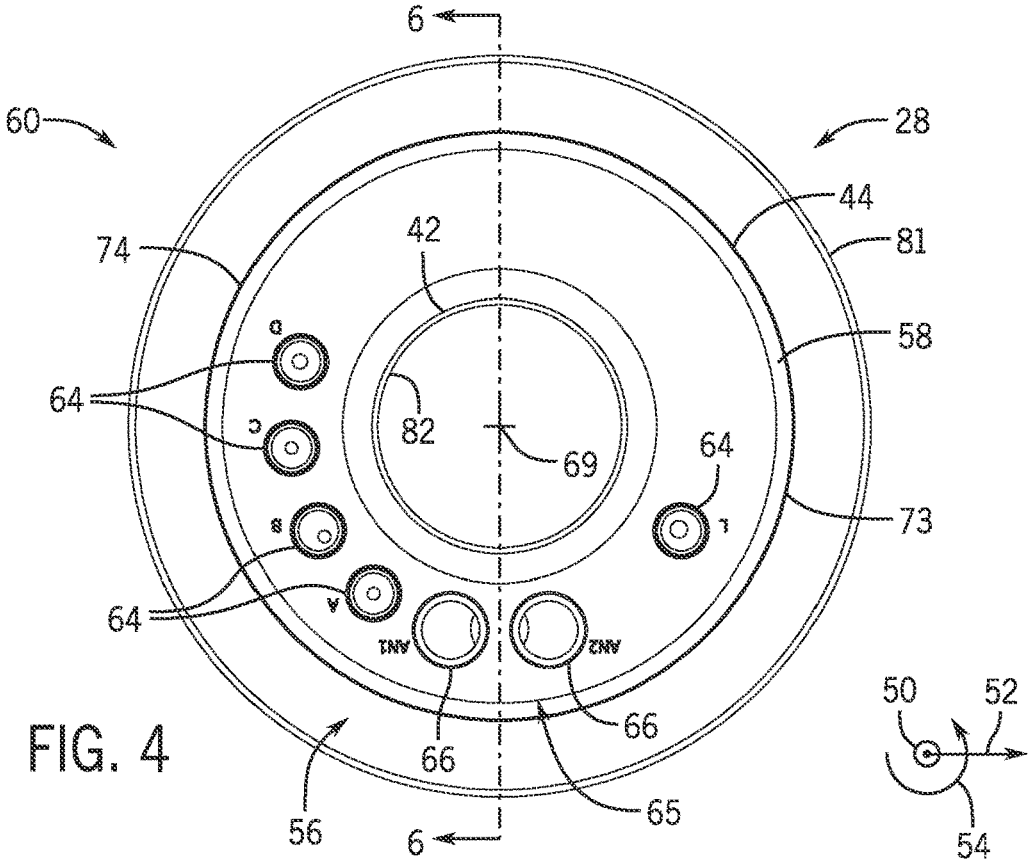
FIG. 4 is a top view of the tubing hanger assembly taken along line 4-4 of FIG. 2, according to an embodiment of the present disclosure.

FIG. 4 is a top view of the tubing hanger assembly 60 of FIGS. 2-3, taken along line 4-4 of FIG. 2. On the first axial end portion 74, the through bores 64 and the upper bores 66 are disposed between an inner annular surface 82 of the central bore 42 and the outer annular surface 73 of the annular wall 58 of the tubing hanger body 44. The through bores 64 are circumferentially offset from one another in the circumferential direction 54 about the axial axis 50 (e.g., centerline 69). As illustrated, some of the through bores 64 may be opposite from the other through bores 64 with respect to the central bore 42 (e.g., the central bore 42 is disposed at least partially or directly between the through bores 64). The through bores 64 may have the same or different sizes (e.g., diameters or cross-sectional areas). However, in the illustrated embodiment, the through bores 64 have a common size. The through bores 64 may provide paths for fluids (e.g., hydraulic control fluid, lubricating fluid, chemical injection fluid) and connections allowing for lines and/or cables (e.g., injection lines, power lines, communication lines, fiber optical cables). As illustrated in the first axial end portion 74 shown in FIG. 4, a substantial amount of the annular wall 58 is not used for the through bores 64, and thus this substantial amount of the annular wall 58 can be used for connecting the discontinuous bores 65.

The upper bores 66 are circumferentially offset from one another in the circumferential direction 54 about the axial axis 50 (e.g., centerline 69). Additionally, the upper bores 66 are circumferentially offset from the through bores 64 in the circumferential direction 54 about the axial axis 50 (e.g., centerline 69). The upper bores 66 may have equal or different sizes (e.g., diameters or cross-sectional areas). However, in the illustrated embodiment, the upper bores 66 have a common size, which is less than the size of the through bores 64. The upper bores 66 are discontinuous bores 65 extending from the first axial end portion 74 downward along the axial axis 50 and joining the intersecting bore 72 that extends downward to the annular plenum 62. Other cross-sections of the tubing hanger 28 are discussed in further detail below.

Figure 5:
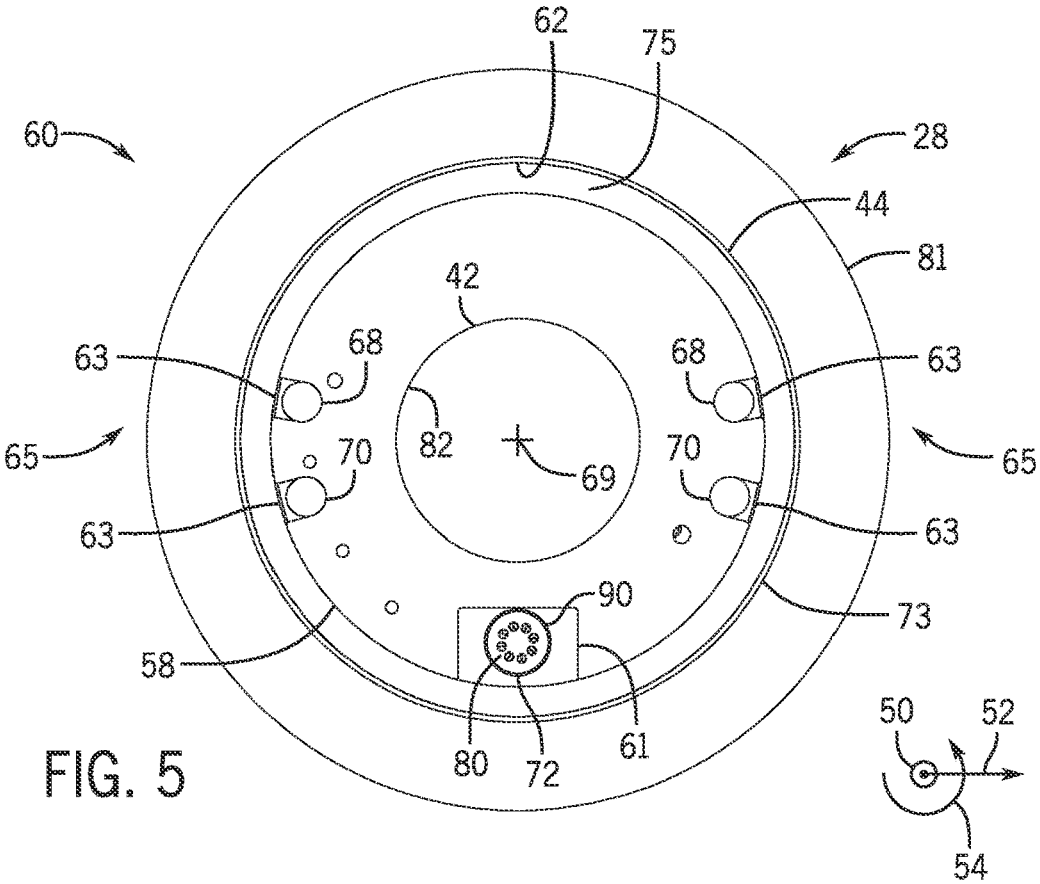
FIG. 5 is a cross-sectional view of the tubing hanger assembly taken along line 5-5 of FIG. 2, according to an embodiment of the present disclosure.

FIG. 5 is a cross-sectional view of the tubing hanger assembly 60 of FIGS. 2-4 taken along line 5-5 of FIG. 2, further illustrating the fluid connections at the annular plenum 62. As illustrated, the two pairs of lower bores 68 and 70 are fluidly coupled to the annular plenum 62 via the cross-bores 63, which extend in the radial direction 52 from the lower bores 68 and 70 into the annular plenum 62. Although the lower bores 68 and 70 are described as being arranged in pairs, the lower bores 68 and 70 may be arranged with any numbers, spacings, or configurations, not limited to pairs or sets. For example, the lower bores 68 and 70 may simply represent any number (e.g., 1, 2, 3, 4, 5, 6, 7, 8, 9, 10, or more) lower bores coupled with the annular plenum 62. The lower bores 68 and 70 are disposed radially between the inner annular surface 82 of the central bore 42 and the outer annular surface 73 of the annular wall 58 of the tubing hanger body 44. The lower bores 68 and 70 are circumferentially offset from one another in the circumferential direction 54 about the axial axis 50 (e.g., centerline 69). As illustrated, the lower bores 68 and 70 may be opposite from one another with respect to the central bore 42 (e.g., approximately 180 degrees apart). The lower bores 68 and 70 may have the same or different sizes.

As further illustrated in FIG. 5, the annular plenum 62 is fluidly coupled with the intersecting bore 72 via the cross-bore 61, which is substantially oversized relative to the intersecting bore 72. As discussed above, the intersecting bore 72 extends axially between the second axial end portion 76 and the intermediate position 71, where the intersecting bore 72 connects with the upper bores 66. The THAID 80 is disposed in a lower bore portion (e.g., an annulus bore 90) of the intersecting bore 72 between the annular plenum 62 and the second axial end portion 76. For example, the THAID 80 may extend across the cross-bore 61, such that the THAID 80 can be moved (e.g., axially, rotationally, etc.) to open and close the cross-bore 61 to enable or disable fluid flow between the intersecting bore 72 and the annular plenum 62. The annulus bore 90 is disposed in the tubing hanger body 44. In certain embodiments, the intersecting bore 72 (including the annulus bore 90) is circumferentially offset from other bores, such as the lower bores 68 and 70, in the circumferential direction 54 about the axial axis 50 (e.g., centerline 69). In certain embodiments, the intersecting bore 72 (including the annulus bore 90) may be larger or smaller in size than the lower bores 68 and 70, but smaller in size than the central bore 42. Additionally, the intersecting bore 72 (including the annulus bore 90) may be larger or smaller in size than the upper bores 66, but smaller in size than the central bore 42. In certain embodiments, all of the through bores 64, the discontinuous bores 65 (e.g., 66, 68, and 70), and the intersecting bore 72 (including the annulus bore 90) may be sized based on the available space between the outer annular wall 73 and the inner annular wall 82 of the annular wall 58, such that the diameter of each of the bores 64, 65, and 72 is smaller than the radial distance between the outer and inner annular walls 73 and 82.

Figure 6:
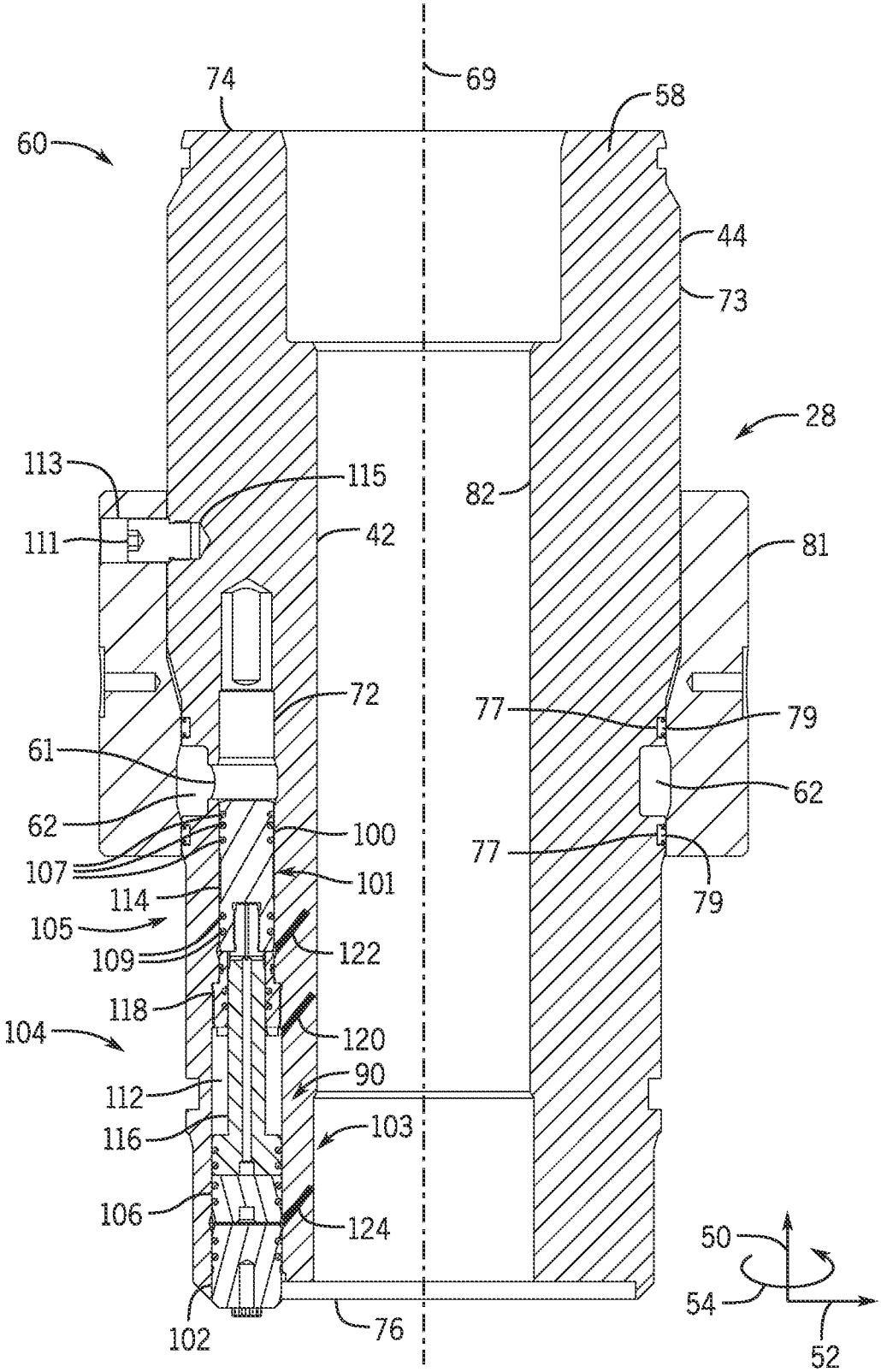
FIG. 6 is cross-sectional view of the tubing hanger assembly taken along line 6-6 of FIG. 4, further illustrating an open valve position of a valve, according to an embodiment of the present disclosure.

FIG. 6 is cross-sectional view of the tubing hanger assembly 60 taken along line 6-6 of FIG. 4, further illustrating the THAID 80 in an open valve position. The THAID 80 (or another suitable valve) is a sub-component or sub-assembly of the tubing hanger 28, such as a self-contained or self-retained valve assembly. The THAID 80 is removably mounted in a bore portion (e.g., the annulus bore 90) of the intersecting bore 72. For example, the THAID 80 may be axially inserted and sealed within the intersecting bore 72 (e.g., annulus bore 90), for example, by pushing the THAID 80 into the intersecting bore 72 from the second axial end portion 76 and sealing the THAID 80 within the intersecting bore 72. For example, the THAID 80 may be press-fit within the intersecting bore 72 to provide an interference fit within the intersecting bore 72. Additionally or alternatively, the THAID 80 may be sealed within the intersecting bore 72 via a seal assembly or seal carrier 100 and/or a plug 102. In the illustrated embodiment, the seal carrier 100 (e.g., an annular seal carrier having one or more annular seals) is disposed on a first end portion 101 of the THAID 80, while the plug 102 (e.g., cylindrical plug) is disposed in the intersecting bore 72 at a second end portion 103 of the THAID 80.

The THAID 80 may include a set of hydraulically controlled elements, such as a rod assembly 104 and a floating piston 106 that extend and retract a set of seals across an annulus flow path 112 to block or permit annulus flow communication, respectively. The rod assembly 104 may include an upper rod body 114 and a lower rod body 116 disposed on opposite sides with respect to a cavity separator 118. The set of hydraulically controlled elements (e.g., 104, 106) may extend or retract with hydraulic fluids being applied to different supply lines, such as an open supply line 120, a primary close supply line 122, and a secondary close supply line. Such movements may enable three independent hydraulic control functions: open, primary close, and secondary close. Correspondingly, the THAID 80 may operate in three positons: the open position as illustrated in FIG. 6 and two close positions, including a primary close position and a secondary close position as illustrated below with reference to FIGS. 7 and 8, respectively.

For example, when a pressurized fluid (e.g., hydraulic fluid) is applied to the open supply line 120, the pressurized fluid fills and pressurizes the annulus flow path 112 (or chamber), thereby driving the rod assembly 104 in an axial downward direction toward the plug 102. In this example, the THAID 80 operates in the open position acting as an opening valve. Collectively, the upper rod body 114 and the seal carrier 100 define a valve element 105 (e.g., cylindrical valve), wherein the valve element 105 includes one or more seals 107 (e.g., annular seals) in the seal carrier 100 and one or more seals 109 (e.g., annular seals) in a lower portion of the upper rod body 114. The seals 107 and 109 are axially offset from one another along the intersecting bore 72. In the open valve position of FIG. 6, the entire valve element 105 including the seals 107 and 109 is disposed in the intersecting bore 72 (e.g., annulus bore 90) below the annular plenum 62 and the cross-bore 61, which connects the annular plenum 62 with the intersecting bore 72. As a result, fluid flow is allowed between the intersecting bore 72 and the annular plenum 62 via the cross-bore 61, which is not blocked by the valve element 105. As further illustrated in FIG. 6, the annular sleeve 81 is sealed about the annular wall 58 via the seals 79 to define the annular plenum 62, which distributes the fluid flow to the lower bores 68 and 70. Additionally, the annular sleeve 81 is removably coupled to the annular wall 58 via one or more fasteners 111 (e.g., threaded bolts) extending through radial bores 113 in the annular sleeve 81 and connecting with mating fastener receptacles 115 (e.g., threaded holes).

Figure 7:
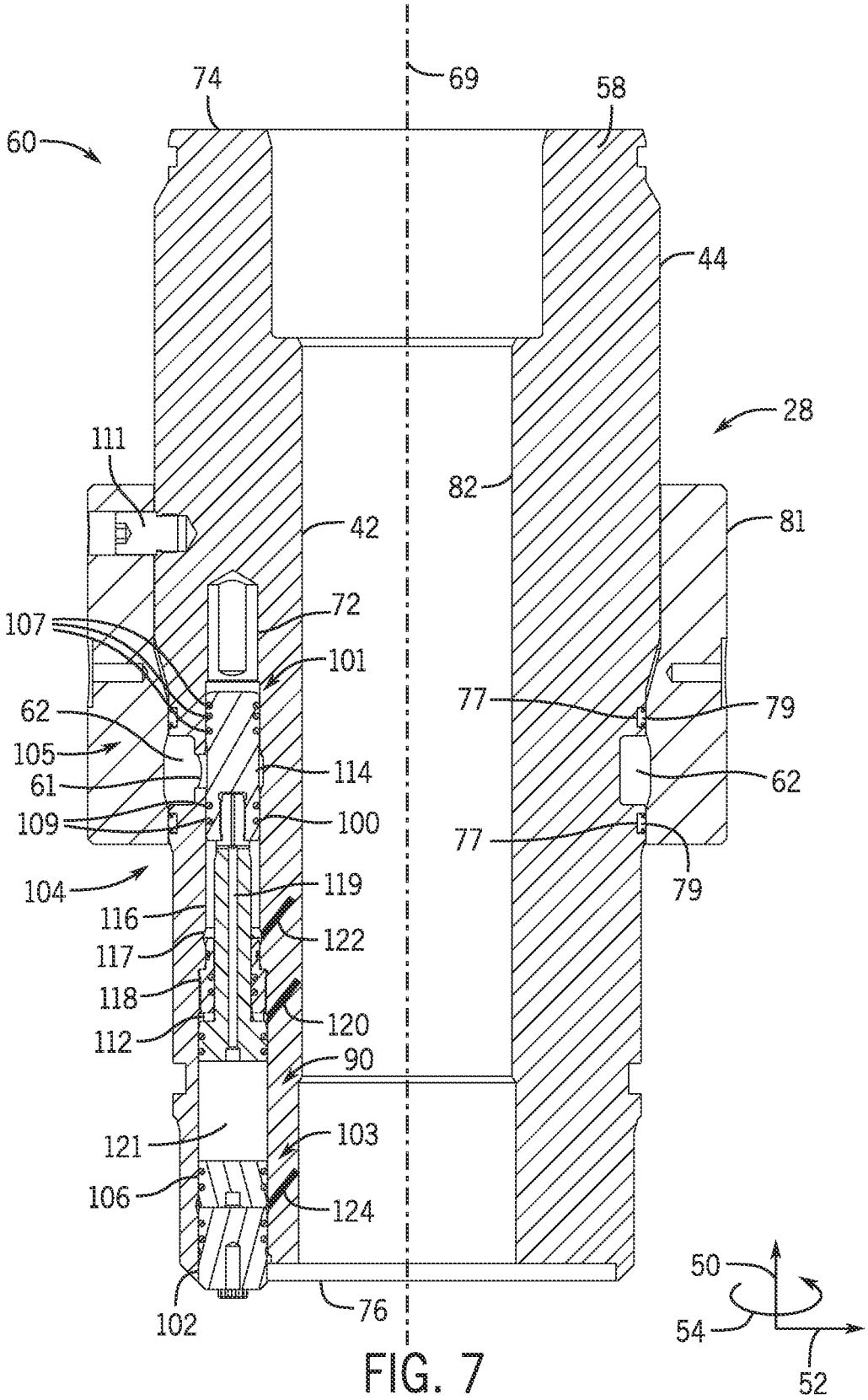
FIG. 7 is a cross-sectional view of the tubing hanger assembly taken along line 6-6 of FIG. 4, further illustrating a primary closed valve position of the valve, according to an embodiment of the present disclosure.

FIG. 7 is a cross-sectional view of the tubing hanger assembly 60 taken along line 6-6 of FIG. 4, further illustrating the THAID 80 in a primary closed valve position. For example, when a pressurized fluid (e.g., hydraulic pressure) is applied to the primary close supply line 122, the pressurized fluid flows into an annular fluid chamber 117, which then feeds the pressurized fluid through an axial bore 119 in the rod assembly 104 to a lower annular fluid chamber 121. The pressurized annular fluid chamber 121 then drives the rod assembly 104 in an axial upward direction toward the seal carrier 100, thereby axially moving the valve element 105 including the seals 107 and 109 across the cross-bore 61 to close fluid flow between the intersecting bore 72 and the annular plenum 62. Accordingly, the THAID 80 operates in the primary closed valve position acting as a primary closing valve for the discontinuous bores 65 (e.g., upper bores 66 and lower bores 68 and 70), by blocking fluid flow through the cross-bore 61 and the annular plenum 62. As illustrated in FIG. 7, the floating piston 106 remains at a lower axial position against the plug 102.

Figure 8:
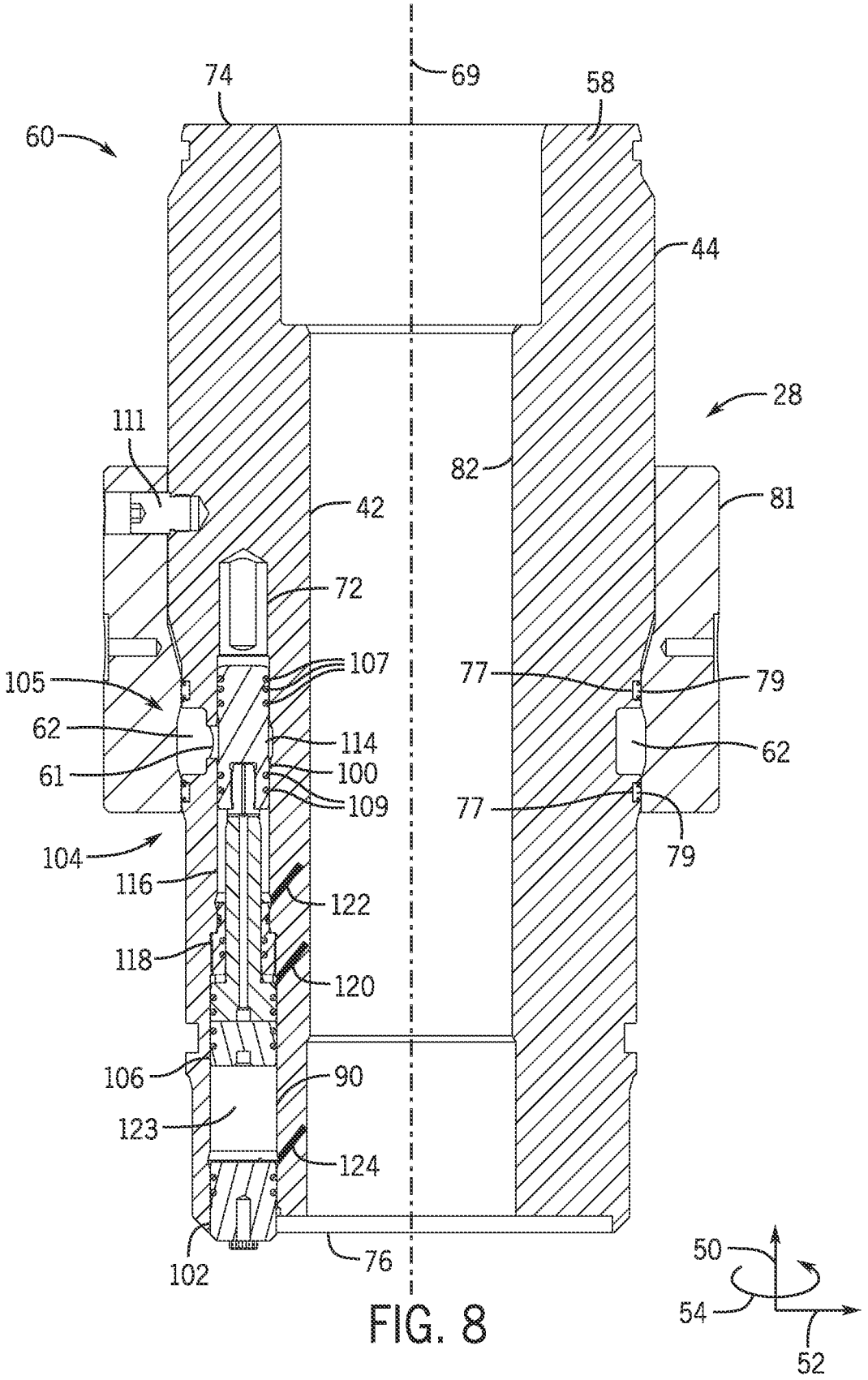
FIG. 8 is a cross-sectional view of the tubing hanger assembly taken along line 6-6 of FIG. 4, further illustrating in a secondary closed valve position of the valve, according to an embodiment of the present disclosure.

FIG. 8 is a cross-sectional view of the tubing hanger assembly 60 taken along line 6-6 of FIG. 4, further illustrating the THAID 80 in a secondary closed valve position. For example, when a pressurized fluid (e.g., hydraulic fluid) is applied to the secondary close supply line 124, the pressurized fluid fills and pressurizes an annular fluid chamber 123, thereby driving the floating piston 106 in an upward axial direction against the rod assembly 104. The rod assembly 104 in turn is driven in the upward axial direction toward the seal carrier 100, thereby helping to seal and hold the axial position of the valve element 105. In other words, the pressurized fluid in the annular fluid chamber 123 provides an upward biasing force to hold the valve element 105 in place by holding the floating piston 106 against the rod assembly 104.

Figure 9:
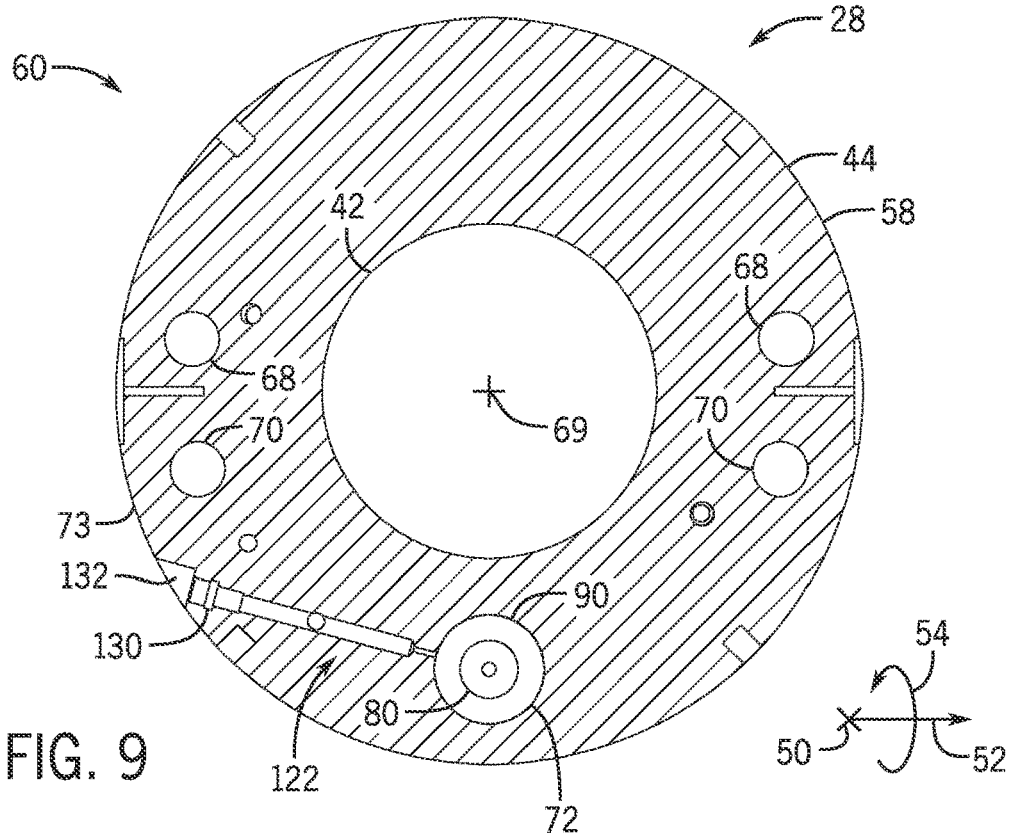
FIG. 9 is a cross-sectional view of the tubing hanger assembly taken along line 9-9 of FIG. 2, further illustrating a cross-bore of a primary close supply line of the valve, according to an embodiment of the present disclosure.

FIG. 9 is a cross-sectional view of the tubing hanger assembly 60 taken along line 9-9 of FIG. 2, further illustrating an embodiment of a cross-bore 130 of the primary close supply line 122 discussed in detail above. The cross-bore 130 extends outwardly from the intersecting bore 72 (e.g., annulus bore 90) toward the outer annular surface 73 of the annular wall 58. The pressurized fluid may be supplied to the cross-bore 130 by connecting with a fluid connector 132.

Figure 10:
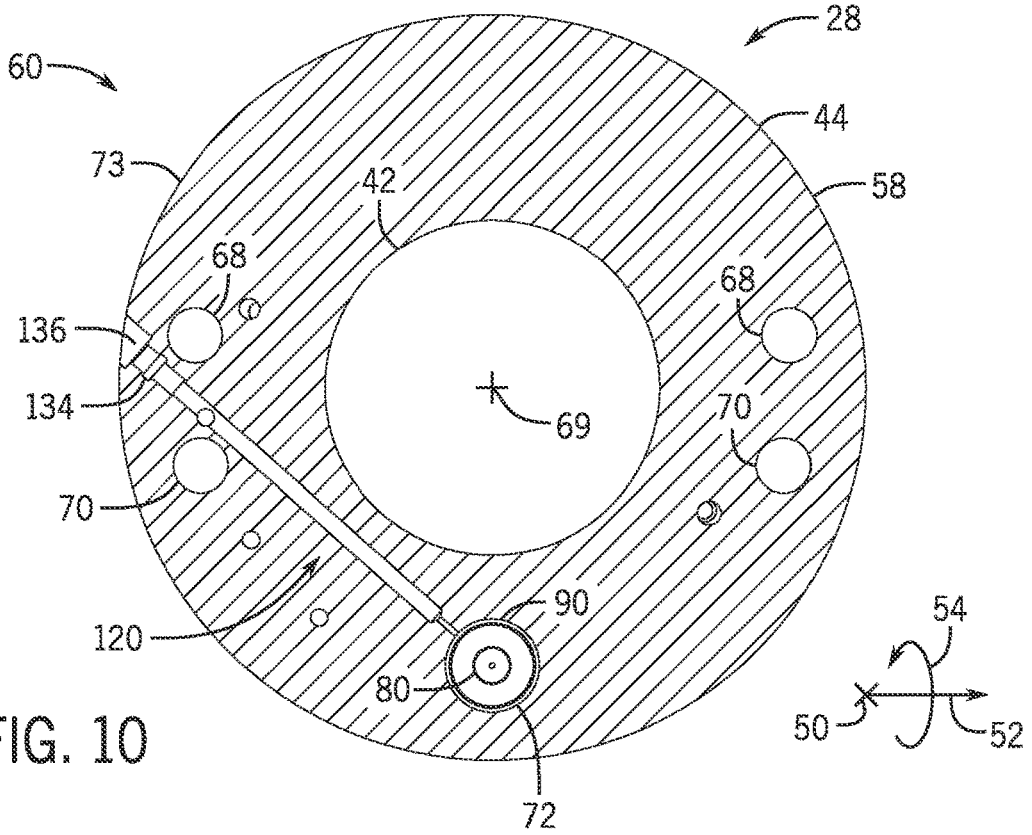
FIG. 10 is a cross-sectional view of the tubing hanger assembly taken along line 10-10 of FIG. 2, further illustrating a cross-bore of an open supply line of the valve, according to an embodiment of the present disclosure.

FIG. 10 is a cross-sectional view of the tubing hanger assembly 60 taken along line 10-10 of FIG. 2, further illustrating an embodiment of a cross-bore 134 of the open supply line 120 discussed in detail above. The cross-bore 134 extends outwardly from the intersecting bore 72 (e.g., annulus bore 90) toward the outer annular surface 73 of the annular wall 58. The pressurized fluid may be supplied to the cross-bore 134 by connecting with a fluid connector 136.

Figure 11:
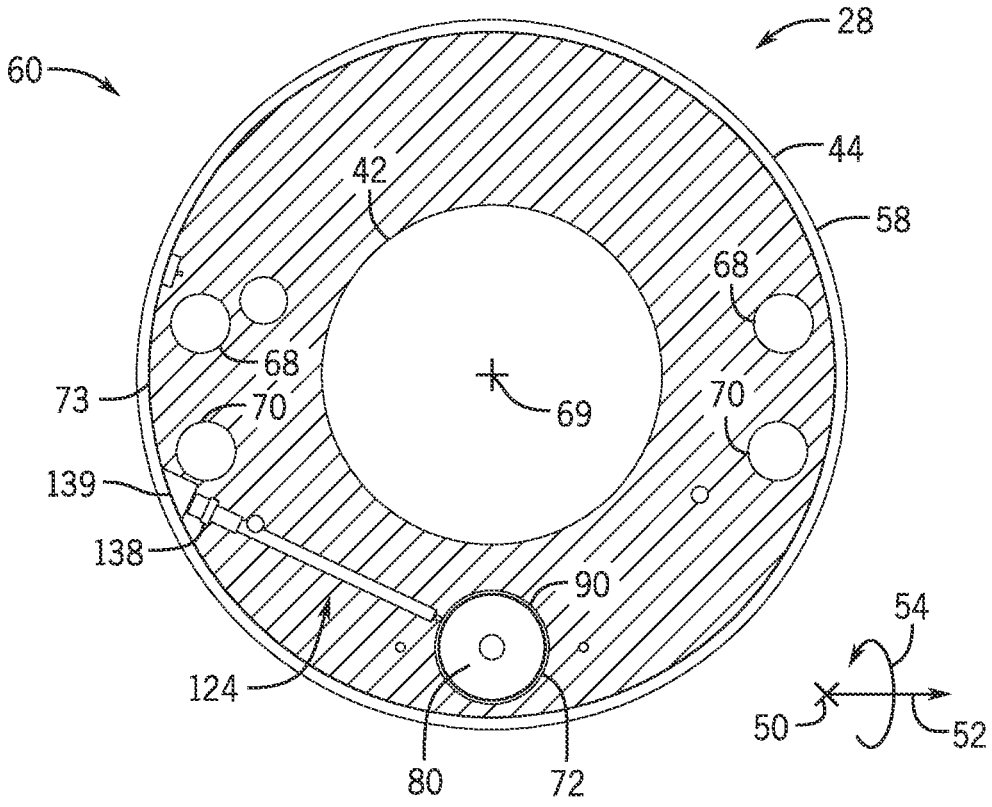
FIG. 11 is a cross-sectional view of the tubing hanger assembly taken along line 11-11 of FIG. 2, further illustrating a cross-bore of a secondary close supply line of the valve, according to an embodiment of the present disclosure.

FIG. 11 is a cross-sectional view of the tubing hanger assembly 60 taken along line 11-11 of FIG. 2, further illustrating an embodiment of a cross-bore 138 of the secondary close supply line 124 discussed in detail above. The cross-bore 138 extends outwardly from the intersecting bore 72 (e.g., annulus bore 90) toward the outer annular surface 73 of the annular wall 58. The pressurized fluid may be supplied to the cross-bore 138 by connecting with a fluid connector 139.

Figure 12:
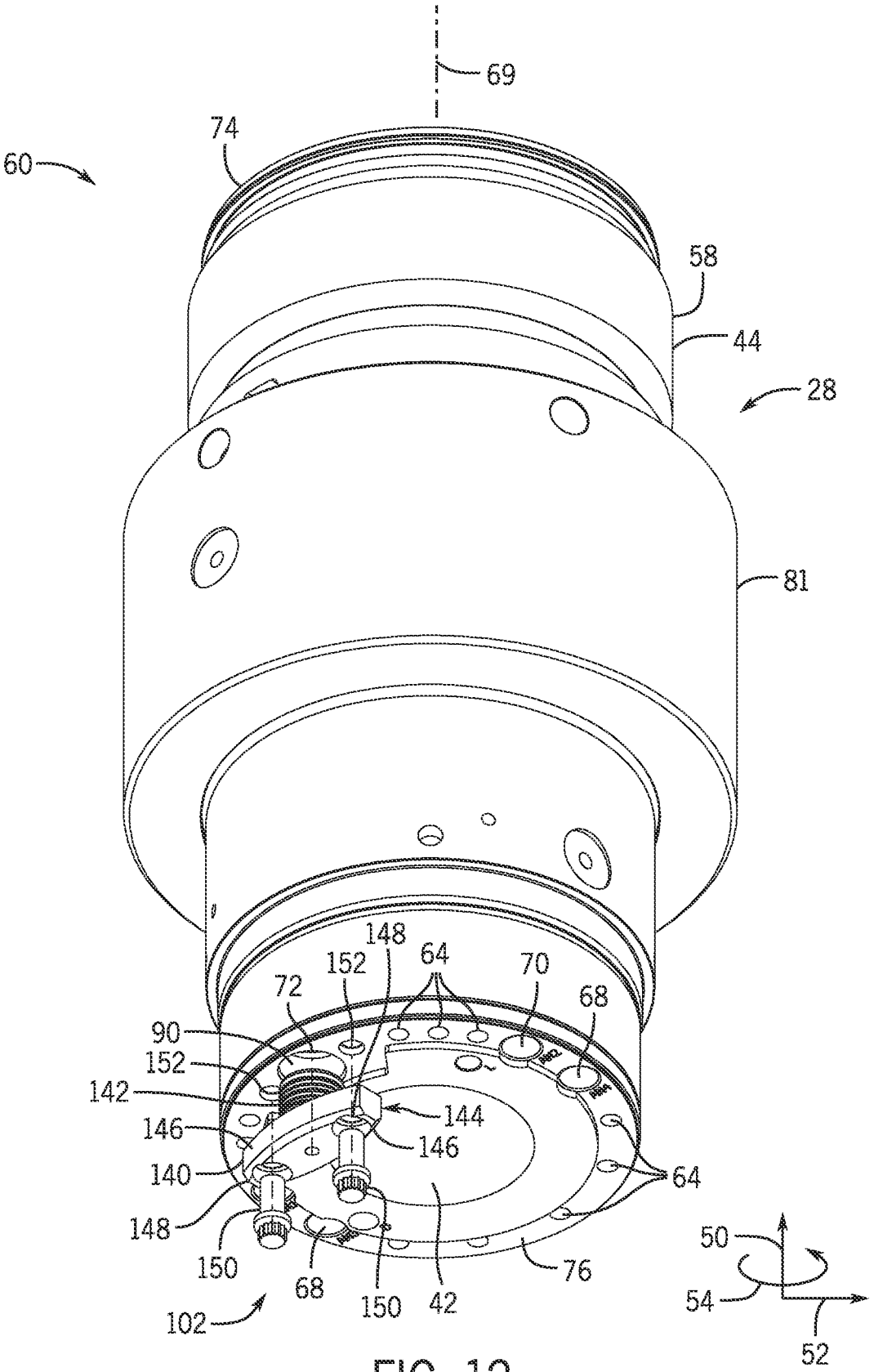
FIG. 12 is an exploded perspective view of the tubing hanger assembly of FIGS. 1-11, further illustrating a flanged plug being installed into a bore of the valve, according to an embodiment of the present disclosure.

FIG. 12 is an exploded perspective view of the tubing hanger assembly 60 of FIGS. 1-11, further illustrating an embodiment of the plug 102 disposed in the intersecting bore 72 (e.g., annulus bore 90) at the second axial end portion 76. In the illustrated embodiment, the plug 102 includes a flanged plug 140, wherein the flanged plug 140 includes an axially protruding plug portion 142 (e.g., cylindrical plug) coupled to a head portion or flange portion 144. The flange portion 144 is substantially wider than a diameter of the plug portion 142, such as at least 1.5, 2, 2.5, 3, 3.5, 4, 4.5, 5, 6, 7, 8, 9, or 10 times the diameter of the plug portion 142. For example, the flange portion 144 may have a length to width radio of 1.5:1 to 20:1, 2:1 to 15:1, 2.5:1 to 10:1, or 3:1 to 5:1. The flange portion 144 extends laterally beyond the diameter of the plug portion 144, thereby defining a plurality of lateral ears or mounting portions 146. The illustrated embodiment of the flange portion 144 includes only two mounting portions 146; however, the flange portion 144 may have any number and arrangement of mounting portions 146. The illustrated mounting portions 146 extend from the plug portion 144 in opposite circumferential directions 54, such that the flange portion 144 is elongated in the circumferential direction 54. However, depending on the available space, the mounting portions 146 may extend from the plug portion 144 in opposite radial directions 52.

As illustrated, the flange portion 144 is not an annular flange disposed circumferentially about an entire circumferent of the central bore 42 (e.g., coaxial with the central bore 42), but instead the flange portion 144 extends only a portion of a circumferential distance about the central bore 42. For example, the flange portion 144 may extend in the circumferential direction 54 only about 5 to 180 degrees, 5 to 120 degrees, 5 to 90 degrees, 5 to 60 degrees, 5 to 45 degrees, 5 to 30 degrees, or 5 to 20 degrees about the centerline 69. The flange portion 144 also may be curved or rounded on both sides to fit within the curvature of the outer annular surface 73 and/or the inner annular surface 82. For example, the flange portion 144 may have an oval shape with or without truncated ends, an arcuate shape with inner and outer curved surfaces matched to the inner and outer annular surfaces 73 and 82, a rectangular shape, or any other suitable geometry. In the illustrated embodiment, the flanged portion 144 may be asymmetric relative to a central axis of the plug portion 142 and the intersecting bore 72. Additionally, in the illustrated embodiment, the flanged portion 144 may be symmetric relative to a plane along the axis of the plug portion 142 and the intersecting bore 72, wherein the plane may extend in the radial direction 52 or the circumferential direction 54. Alternatively, the flanged portion 144 may be asymmetric relative to the plane, such that the flanged portion 144 does not have any symmetry.

Each of the mounting portions 146 includes a fastener receptacle 148 (e.g., bolt hole) configured to pass a fastener 150 (e.g., threaded bolt, threaded shaft and nut, latch, pin, clamp, etc.) through the mounting portion 146 and into a mating fastener receptacle 152 (e.g., threaded hole) in the second axial end portion 76 of the annular wall 58 of the tubing hanger body 44. Accordingly, the flanged plug 140 is configured to plug the intersecting bore 72 in a relatively compact manner, such that the flanged plug 140 reduces the amount of space used to seal the intersecting bore 72 to help increase the amount of available space in the annular wall 58 for various bores (e.g., through bores 64 and discontinuous bores 65).

The flanged plug 140 is more compact than other designs, such as using an oversized plug in the intersecting bore 72. For example, if the intersecting bore 72 is closed off with an oversized threaded plug, then the intersecting bore 72 may require an oversized bore diameter at the second axial end portion 76. As a result, the oversized threaded plug will use more space than the illustrated flanged plug 140, which in turn reduces the amount of possible fluid flow through various bores (e.g., through bores 64 and discontinuous bores 65).

The flanged plug 140 is also asymmetric relative to the centerline 69 of the tubing hanger 28, thereby minimizing the footprint of the flanged plug 140 along the second axial end portion 76. In contrast, a flanged cap or cover that is concentric or coaxial with the centerline 69 (e.g., an annular cap over the second axial end portion 76) would reduce the available space and/or complicate the implementation of the various bores (e.g., through bores 64 and discontinuous bores 65). On the other hand, a flanged cover with a circular arrangement of fasteners about the centerline 69 may be advantageous as it would help to distribute the load and use smaller fasteners. Nevertheless, in a tubing hanger 28 with limited space for the various bores (e.g., through bores 64 and discontinuous bores 65), the disclosed compact design of the flanged plug 140 and the two bolts 150 may solve the problems described above by providing an end connection that may sustain loads without consuming additional footprint in the radial direction. For example, by putting the two bolts 150 in a circumferential direction (e.g., the circumferential direction 54) where space is not at a premium, the two bolts 150 can be sized as needed for capacity. Such design also improves the flexibility of tubing hanger implementations.

The compact design of the flanged plug 140 used with the THAID 80 allows the THAID 80 to be efficiently packaged into the annular wall 58 of the tubing hanger 28. The flanged plug 140 provides an end connection of the THAID 80 to retain axial loads induced by hydraulic pressure above that is used for opening or closing the THAID 80, as described previously with reference to FIGS. 6-8. The end connection may limit the overall size of the THAID 80 as all components are installed past the end connection geometry. The disclosed design provide a solution that is capable of increasing the cross-sectional areas of the various bores (e.g., through bores 64 and discontinuous bores 65), thereby helping to increase (e.g., maximize) the throughput of fluid flow within the annular wall 58.

As illustrated, the bolts 150 are disposed oppositely from each other with respect to the annulus bore 90. Such arrangement may be used in areas where radial space does not permit a full flange and the flanged bore size is being maximized to pass equipment there through. While a two-bolt flange is shown in the present embodiment, in other embodiments, more bolts (e.g., three, four, or more smaller bolts) may be used.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform] ing [a function] . . . " or "step for [perform] ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A system, comprising:

a hanger, comprising:

an annular plenum disposed circumferentially about an axis of the hanger;

a first bore extending from a first axial end portion of the hanger to the annular plenum; and a second bore extending from a second axial end portion of the hanger to the annular plenum;

wherein the first and the second axial end portions are opposite from one another;

wherein the first bore comprises a plurality of first bores coupled to an intersecting bore, and the intersecting bore is coupled to the annular plenum;

wherein the second bore comprises a plurality of second bores offset from one another, wherein the plurality of second bores are offset from the plurality of first bores;

wherein the intersecting bore is coupled to the annular plenum at a first cross-bore, and each of the plurality of second bores is coupled to the annular plenum at a second cross-bore.

2. The system of claim 1, wherein the first and the second bores are circumferentially offset from one another about the axis, radially offset from one another relative to the axis, or a combination thereof.

3. The system of claim 1, comprising a valve configured to control a fluid flow through the annular plenum between the first bore and the second bore.

4. The system of claim 3, wherein the valve comprises a tubing hanger annulus isolation device (THAID) comprising a rod assembly and a floating piston configured to move with hydraulic pressures applied to a plurality of supply lines coupled to the hanger.

5. The system of claim 4, wherein the movement of the rod assembly and the floating piston enables three independent hydraulic control functions, comprising:

an open function configured to open communication of the first bore and the second bore, wherein the open function corresponds to the THAID operating in a first position with a first hydraulic fluid applied to a first supply line of the plurality of supply lines;

a primary close function configured to block the communication of the first bore and the second bore, wherein the primary close corresponds to the THAID operating in a second position with a second hydraulic fluid applied to a second supply line of the plurality of supply lines; and a secondary close function configured to block the communication of the first bore and the second bore, wherein the secondary close corresponds to the THAID operating in a third position with a third hydraulic fluid applied to a third supply line of the plurality of supply lines.

6. The system of claim 4, wherein the rod assembly comprises a first portion and a second portion disposed on opposite sides with respect to a cavity separator.

7. The system of claim 3, comprising a flanged plug configured to seal the valve in a third bore extending from the second axial end portion of the hanger to the annular plenum, wherein the flanged plug comprises a plug portion axially protruding from a flange portion, wherein the flange portion has mounting portions extending laterally beyond the plug portion, the flange portion is asymmetric relative to a central axis of the plug portion, and at least two fasteners couple the mounting portions to the second axial end portion.

8. The system of claim 1, wherein the annular plenum comprises an annular groove in an outer annular surface of an annular wall of the hanger, further comprising an annular sleeve disposed about the annular groove and sealed against the outer annular surface of the annular wall.

9. The system of claim 1, wherein the hanger is mounted in a wellhead.

10. The system of claim 1, wherein the first bore comprises a plurality of first bores, or the second bore comprises a plurality of second bores, or a combination thereof.

11. The system of claim 1, wherein the intersecting bore extends through the second axial end portion, a valve is disposed in the intersecting bore and configured to open and close a fluid flow between the plurality of first bores and the annular plenum, and a plug is coupled to the intersecting bore at the second axial end portion.

12. The system of claim 11, wherein the plug comprises a flanged plug having a plug portion axially protruding from a flange portion, wherein the flange portion has mounting portions extending laterally beyond the plug portion, the flange portion is asymmetric relative to a central axis of the plug portion, and at least two fasteners couple the mounting portions to the second axial end portion.

13. A method, comprising:

directing a fluid flow through a first bore extending from a first axial end portion of a hanger to an annular plenum, wherein the annular plenum is disposed circumferentially about an axis of the hanger;

directing the fluid flow from the first bore through the annular plenum to a second bore extending from a second axial end portion of the hanger to the annular plenum wherein the first and the second axial end portions are opposite from one another, wherein each of the first and second bores extends only partially between the first and second axial end portions such that the first and second bores are discontinuous bores;

controlling a valve to open and close the fluid flow between the first bore and the annular plenum, wherein the valve is disposed in a third bore extending from the second axial end portion of the hanger to the annular plenum and the first bore; and sealing the third bore via a flanged plug coupled to the third bore at the second axial end portion of the hanger, wherein the flanged plug comprises a plug portion axially protruding from a flange portion, the flange portion has mounting portions extending laterally beyond the plug portion, the flange portion is asymmetric relative to a central axis of the plug portion, and at least two fasteners couple the mounting portions to the second axial end portion of the hanger.

* * * * *